US008121330B2

(12) United States Patent
Dodd et al.

(10) Patent No.: US 8,121,330 B2
(45) Date of Patent: Feb. 21, 2012

(54) PHASE PLUG FOR COMPRESSION DRIVER

(75) Inventors: Mark Dodd, Woodbridge (GB); Jack A. Oclee-Brown, Tonbridge (GB)

(73) Assignee: GP Acoustics (UK) Limited, Kent (GB)

( * ) Notice: Subject to any disclaimer, the term of this patent is extended or adjusted under 35 U.S.C. 154(b) by 405 days.

(21) Appl. No.: 12/297,184

(22) PCT Filed: Apr. 13, 2007

(86) PCT No.: PCT/GB2007/001379
§ 371 (c)(1),
(2), (4) Date: Aug. 17, 2009

(87) PCT Pub. No.: WO2007/122390
PCT Pub. Date: Nov. 1, 2007

(65) Prior Publication Data

US 2009/0304218 A1 Dec. 10, 2009

(30) Foreign Application Priority Data

Apr. 13, 2006 (GB) ..... 0607452.0

(51) Int. Cl.
*H04R 25/00* (2006.01)

(52) U.S. Cl. ..... 381/343; 381/337; 381/340

(58) Field of Classification Search ..... 381/337–340, 381/343
See application file for complete search history.

(56) References Cited

U.S. PATENT DOCUMENTS 4,050,541 A 9/1977 Henricksen
4,143,738 A 3/1979 Nakazono et al.
4,157,741 A 6/1979 Goldwater
4,628,155 A 12/1986 Robineau et al.
5,117,462 A 5/1992 Bie
5,548,657 A 8/1996 Fincham
5,742,696 A 4/1998 Walton
(Continued)

FOREIGN PATENT DOCUMENTS

GB 654378 A 6/1951
(Continued)

OTHER PUBLICATIONS

Bob H. Smith, "An Investigation of the Air Chamber of Horn Type Loudspeakers," The Journal of the Acoustical Society of America, vol. 25, No. 2, Mar. 1953, pp. 305-312.
United Kingdom Intellectual Property Office Search Report, UK Patent Application No. GB0607454.6, Jul. 12, 2006, 1 page.
(Continued)

*Primary Examiner* — Suhan Ni
(74) *Attorney, Agent, or Firm* — Kenneth L. Sherman, Esq.; Michael Zarrabian, Esq.; Myers Andras Sherman & Zarrabian LLP

(57) ABSTRACT

A phase plug comprises a body having an input side for receiving acoustic waves and an output side for transmitting acoustic waves, the body including a plurality of channels extending from the input side to the output side for propagating acoustic waves through the body. The input side comprises an input surface which includes a plurality of openings constituting entrances for the channels, the input surface being substantially part of a sphere or an ellipsoid in shape. The areas of the openings vary with radial position on the input surface, the radial position being measured in a direction extending perpendicularly from a central axis extending through the input surface. The variation in the areas is a function of the cosine of an angle subtended at the centre of the sphere or a focus of the ellipsoid between the central axis and the radial position.

24 Claims, 6 Drawing Sheets

U.S. PATENT DOCUMENTS

| | | | |
|---|---|---|---|
| 5,778,084 | A | 7/1998 | Kling et al. |
| 6,094,495 | A | 7/2000 | Rocha |
| 2003/0215107 | A1 | 11/2003 | Werner |
| 2004/0156519 | A1 | 8/2004 | Geddes |
| 2005/0105753 | A1 | 5/2005 | Manzini et al. |
| 2010/0290658 | A1 | 11/2010 | Dodd |

FOREIGN PATENT DOCUMENTS

| | | | |
|---|---|---|---|
| JP | 5510217 | A | 1/1980 |
| JP | 04033499 | A | 2/1992 |

OTHER PUBLICATIONS

International Search Report of International Application No. PCT/GB2007/001375, Jul. 8, 2007, 3 pages.

Written Opinion of International Application No. PCT/GB2007/001375, Jul. 8, 2007, 6 pages.

International Search Report of International Application No. PCT/GB2007/001379, dated Jul. 8, 2007.

Written Opinion of the International Searching Authority for PCT/GB2007/001379.

U.S. Non-final Office Action for U.S. Appl. No. 12/297,186 mailed Jun. 22, 2011.

PHASE PLUG FOR COMPRESSION DRIVER

CROSS REFERENCE TO RELATED APPLICATIONS

This application is a national stage application under 35 U.S.C. 371 of PCT/GB2007/001379 filed Apr. 13, 2007, which claims priority of GB 0607452.0 filed Apr. 13, 2006. Both applications, PCT/GB2007/001379 and GB 0607452.0, which are incorporated herein by reference in their entirety.

BACKGROUND OF THE INVENTION

1. Field of the Invention

The present invention relates to loudspeakers, and particularly relates to compression drivers and to phase plugs for compression drivers.

2. Description of Related Art

A compression driver is a type of loudspeaker in which an acoustically radiating diaphragm radiates acoustic waves into a small cavity. The cavity is connected by a phase plug (also known as a phase adaptor, a phase transformer, an acoustic transformer, etc.) to an aperture, which normally opens into a horn waveguide. The small cavity and throat area present the diaphragm with a high acoustic load, and because of this, it tends to be highly efficient. However, the cavity in front of the diaphragm can cause acoustic problems at high frequencies. In particular, the cavity can exhibit strong resonances (known as cavity modes) at distinct frequencies that are commonly within the working band of the compression driver. These resonances can undesirably introduce large pressure response variations in the output of the compression driver. Additionally, the high pressure levels in the cavity that occur when the resonances are excited are undesirable for driver linearity. The severity of the resonance problem is determined primarily by the shape of the cavity, the design of the phase plug and, more specifically, the location and size of the pathways (channels) through the phase plug.

The Journal of the Acoustical Society of America, Volume 25, No. 2, March 1953 (Bob H Smith of the University of California), discloses an investigation of the air chamber of horn type loudspeakers, which includes a method of calculating the positions and sizes of the entrances to the channels (pathways) in a phase plug with annular channels (slots). The aim of the disclosed method is to avoid the excitation of resonances caused by the motion of the air entering and leaving the channels in the phase plug. According to the mathematical analysis presented in that technical paper, in an ideal phase plug with annular channels, the widths of the channels should be very nearly the same irrespective of their radial position in the phase plug, but with increasing radial position the channel width should normally increase very gradually.

Whereas the technical paper by Bob Smith considers only the effect of the motion of the air in the channels, in reality resonances are also excited by the motion of the diaphragm itself. The present inventors have performed a new analysis including the latter effect, and have accordingly devised the present invention.

BRIEF SUMMARY OF THE INVENTION

Accordingly, a first aspect of the present invention provides a phase plug, comprising a body having an input side for receiving acoustic waves and an output side for transmitting acoustic waves, the body including a plurality of channels extending from the input side to the output side for propagating acoustic waves through the body, wherein the input side comprises an input surface which includes a plurality of openings constituting entrances for the channels, the input surface being substantially part of a sphere or an ellipsoid in shape, and wherein the areas of the openings vary with radial position on the input surface, the radial position being measured in a direction extending perpendicularly from a central axis extending through the input surface, the variation in the areas being a function of the cosine of an angle subtended at the centre of the sphere or a focus of the ellipsoid between the central axis and the radial position.

In some preferred embodiments of the invention, as well as the areas of the openings varying with radial position on the input surface, the variation in the areas of the openings may be described by a mathematical relationship which includes the radial position as a function of the relationship. Preferably, the mathematical variation in the areas of the openings is substantially proportional to a function in the range $r\cdot\cos^{1/2}\phi$ to $r\cdot\cos^{2}\phi$, where r is the radial position and $\phi$ is the angle. Most preferably, the variation in the areas of the openings is substantially proportional to $r\cdot\cos\phi$, where r is the radial position and $\phi$ is the angle.

In especially preferred embodiments of the invention, one or more of the openings has the form of one or more slots, each slot having a constant or varying width. (Preferably substantially all of the openings have the form of slots.) For example, in some embodiments, each slot has a substantially constant width, but the widths of the slots vary with radial position on the input surface of the phase plug. Such versions of the invention preferably have a plurality of slots arranged spaced apart from each other in an annular fashion around the central axis of the phase plug. (There will generally be connection parts extending across the annular slots, to join together the parts of the phase plug body that are separated from each other by the slots.) In other embodiments, each slot has a varying width. Such versions of the invention preferably have a plurality of slots arranged in a radial fashion around the central axis of the phase plug. Yet other embodiments of the invention are a combination of these two versions, in which the phase plug includes one or more slots arranged in an annular fashion around the central axis and also includes one or more slots arranged in a radial fashion around the central axis. The annular slot(s) may be situated closer to the central axis than the radial slot(s), or vice versa, and/or the annular slots and radial slots may alternate in a radial direction extending away from the central axis, for example. In all such main types of phase plug according to the invention, the widths of the slots preferably vary with radial position as a function of the cosine of the angle $\phi$.

A second aspect of the invention accordingly provides a phase plug, comprising a body having an input side for receiving acoustic waves and an output side for transmitting acoustic waves, the body including a plurality of channels extending from the input side to the output side for propagating acoustic waves through the body, wherein the input side comprises an input surface which includes a plurality of slots constituting entrances for the channels, the input surface being substantially part of a sphere or an ellipsoid in shape, and wherein the widths of the slots vary with radial position on the input surface, the radial position being measured in a direction extending perpendicularly from a central axis extending through the input surface, the variation in the slot widths being a function of the cosine of an angle subtended at the centre of the sphere or a focus of the ellipsoid between the central axis and the radial position.

In some embodiments of the invention, the variation in the widths of the slots (with radial position on the input surface)

may be described by a mathematical relationship which includes the radial position as a function of the relationship. This is preferably the case for slots that are arranged in a substantially radial orientation on the input surface about the central axis, for example. Thus, for example, the width of each slot may vary substantially in proportion to a function in the range $r \cdot \cos^{1/2}\phi$ to $r \cdot \cos^2\phi$, where r is the radial position and $\phi$ is the angle. More preferably, the width of each slot may vary substantially in proportion to $r \cdot \cos\phi$, where r is the radial position and $\phi$ is the angle. For phase plugs in which one or more of the slots are arranged in a substantially radial orientation on the input surface about the central axis, they preferably are joined to each other via an opening at an axially central region of the input surface.

Additionally or alternatively, for some embodiments of phase plug according to the invention, the variation in the widths of the slots (with radial position on the input surface) may be described mathematically by means of a relationship that does not include the radial position as a function of the relationship. This is preferably the case for slots that are substantially annular or substantially part of an annulus, in shape, for example. Thus, for example, the widths of the slots may vary substantially in proportion to a function in the range $\cos^{1/2}\phi$ to $\cos^2\phi$, where $\phi$ is the angle. Preferably, the widths of the slots vary substantially in proportion to $\cos\phi$, where $\phi$ is the angle. As mentioned above, for embodiments of the phase plug having one or more annular slots, each slot preferably is arranged such that the axis of its annulus is substantially coaxial with the central axis of the phase plug, and preferably each slot has a substantially constant width, but the widths of the slots vary with radial position on the input surface of the phase plug.

In some embodiments of the invention, the input surface is concave, e.g. for use with a diaphragm having a convex radiating surface. Alternatively, in other embodiments of the invention the input surface is convex, e.g. for use with a diaphragm having a concave radiating surface.

A third aspect of the invention provides a compression driver, comprising a phase plug according to the first or second aspect of the invention, and an acoustically radiating diaphragm situated adjacent to the input side of the phase plug.

The diaphragm of the compression driver preferably has either a convex or a concave acoustically radiating surface. Preferably, the acoustically radiating surface of the diaphragm is substantially part of a sphere or an ellipsoid in shape. Advantageously, the acoustically radiating surface of the diaphragm may be substantially rigid.

The compression driver preferably includes a horn waveguide situated adjacent to the output side of the phase plug. In at least some embodiments of the invention, the horn waveguide is non-circular in cross-section perpendicular to the central axis. For example, the horn may be oval in cross-section, or indeed substantially any shape. However, for many embodiments of the invention, the horn waveguide is substantially circular in cross-section perpendicular to the central axis.

The horn waveguide may be substantially frusto-conical (i.e. the horn waveguide may be substantially conical but truncated at the throat of the horn). However, the horn waveguide may be flared, e.g. flared such that it follows a substantially exponential curve, or a substantially parabolic curve, or another flared curve. Other horn waveguide shapes are also possible.

The horn waveguide may be a static waveguide, or it may itself be an acoustically radiating diaphragm, e.g a cone diaphragm. Consequently, in some embodiments of the invention, the horn waveguide may comprise a driven acoustically radiating diaphragm. The horn diaphragm may be driven substantially independently of the dome-shaped diaphragm, for example such that the horn diaphragm is arranged to radiate acoustic waves of generally lower frequency than is the dome-shaped diaphragm. Consequently, the loudspeaker may include a drive unit to drive the horn diaphragm. An example of a suitable arrangement (but without a phase plug according to the present invention) in which the horn waveguide itself comprises an acoustically radiating diaphragm, is disclosed in U.S. Pat. No. 5,548,657.

A fourth aspect of the invention provides a combination loudspeaker comprising an acoustically radiating horn diaphragm, a driver for the horn diaphragm, and a compression driver according to the third aspect of the invention located in, or adjacent to, a throat of the horn diaphragm. Preferably the compression driver is arranged to radiate high frequency sounds, and the horn diaphragm preferably is arranged to radiate low or mid-range frequency sounds.

It is to be understood that any feature of any aspect of the invention may be a feature of any other aspect of the invention.

The phase plug preferably is formed from one or more of: a metal or metal alloy material; a composite material; a plastics material; a ceramic material.

The diaphragm of the compression driver preferably is formed from a substantially rigid low density material, for example one or more of: a metal or metal alloy material; a composite material; a plastics material; a ceramic material. Some preferred metals for forming a suitable metal or metal alloy material include: titanium; aluminium; and beryllium. The acoustically radiating surface of the diaphragm of the compression driver may be formed from a specialist material, for example diamond (especially chemically deposited diamond).

The horn waveguide may be formed from any suitable material, for example one or more of: a metal or metal alloy material; a composite material; a plastics material; a fabric material; a ceramic material. For those embodiments of the invention in which the horn waveguide is an acoustically radiating diaphragm, it preferably is formed from a plastics material or a fabric material, for example. Metal and/or paper may be preferable in some cases.

BRIEF DESCRIPTION OF THE DRAWINGS

Some preferred embodiments of the invention will now be described, by way of example, with reference to the accompanying drawings, of which.

DETAILED DESCRIPTION OF THE INVENTION

Figure 1:
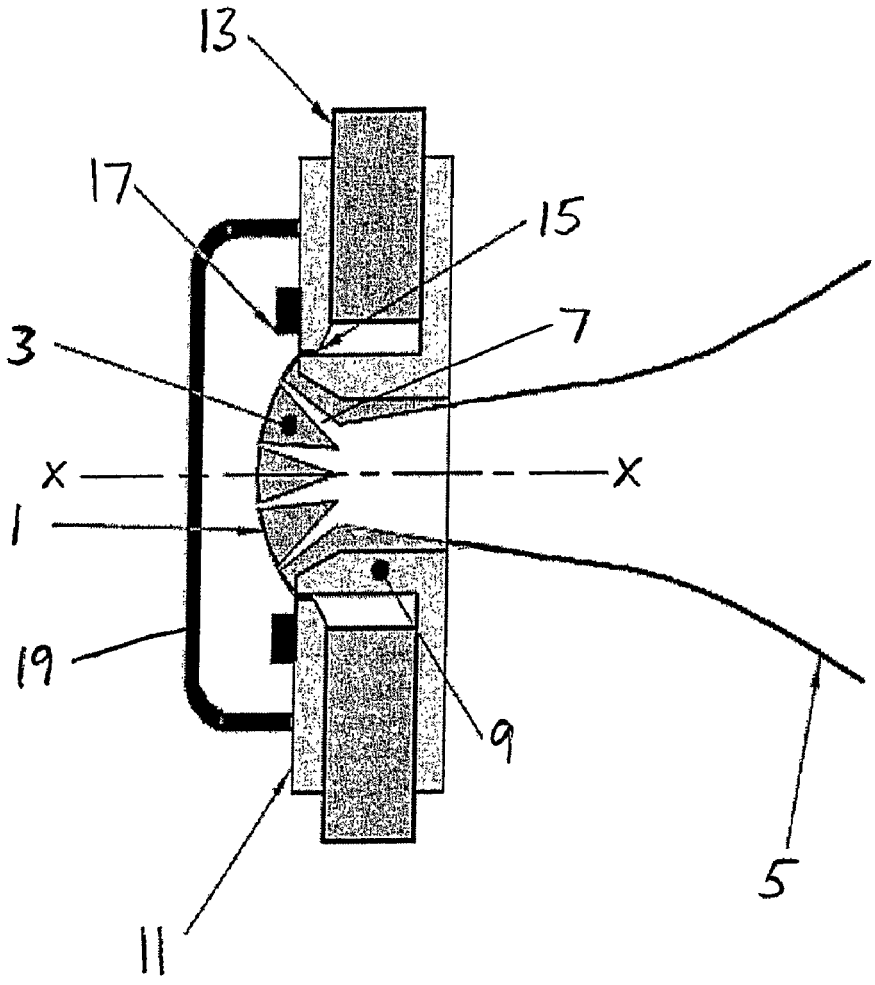
FIG. 1 is a cross-sectional schematic representation of one embodiment of a compression driver according to the invention.

FIG. 1 is a cross-sectional schematic representation of one embodiment of a compression driver according to the invention. The compression driver comprises an acoustically radiating diaphragm 1 having a concave acoustically radiating surface situated adjacent to an input side of a phase plug 3. On an opposite (output) side of the phase plug 3 is a horn waveguide 5. The diaphragm 1, phase plug 3, and horn waveguide 5 have a central axis X-X extending therethrough. The diaphragm 1, phase plug 3, and horn waveguide 5 are arranged such that acoustic waves generated by the diaphragm 1 are propagated through channels 7 extending through the phase plug 3 from the input side to the output side of the phase plug and are then received and propagated by the horn waveguide 5. The diaphragm 1 is driven by means of a driver assembly comprising a centre pole part 9, an outer pole part 11, and a magnet 13. Specifically, an annular skirt portion of the diaphragm 1, which projects from the circumference of the acoustically radiating surface, carries an electrically conductive coil, and the coil and skirt portion of the diaphragm are situated in a gap 15 between the centre pole part 9 and the outer pole part 11, which gap has a magnetic field extending across it. A clamp ring 17 and a rear enclosure part 19 are also shown.

Everything described above with reference to schematic FIG. 1 is conventional and well known to the skilled person. The novelty of the present invention lies primarily in the details of the phase plug, which will now be described.

Figure 2:
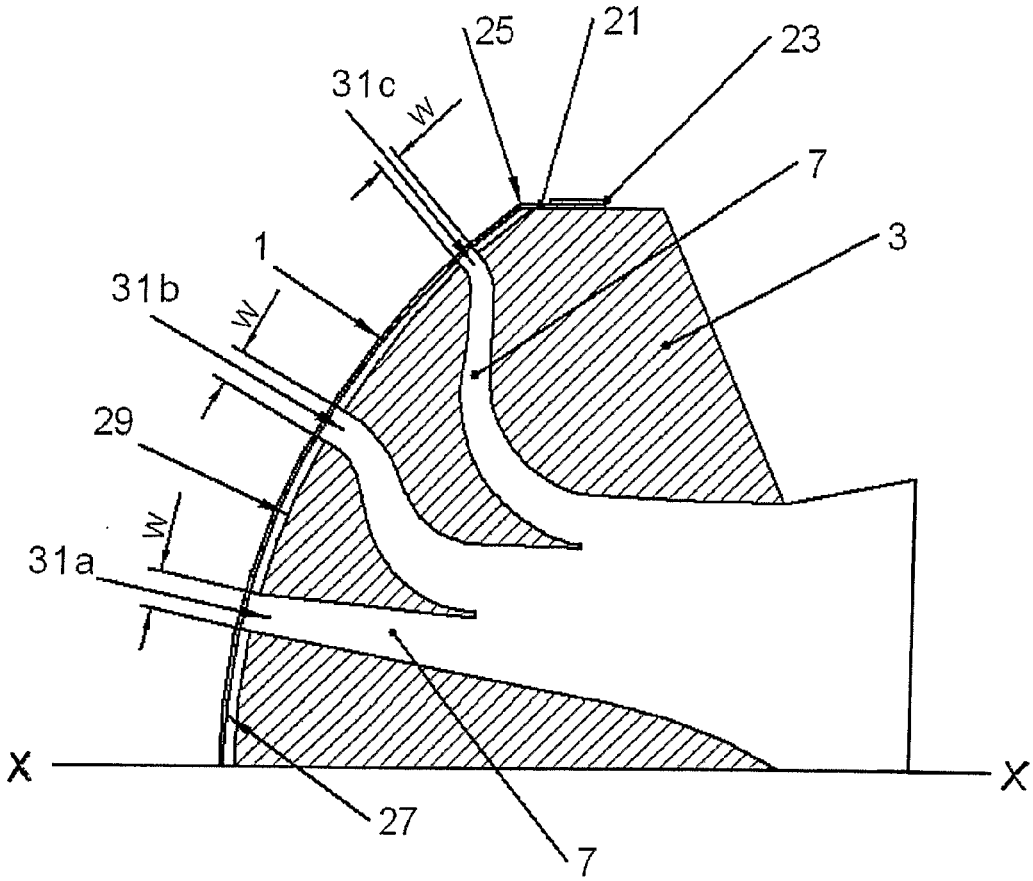
FIG. 2 is a partial cross-sectional schematic representation of a first embodiment of a phase plug according to the invention, together with an acoustically radiating diaphragm.

FIG. 2 is a partial cross-sectional schematic representation of a first embodiment of a phase plug 3 according to the invention, together with an acoustically radiating diaphragm 1, of a compression driver as illustrated schematically in FIG. 1. The annular skirt portion 21 of the diaphragm 1 which carries an electrically conductive coil 23, and which projects from the circumference 25 of the acoustically radiating surface, is shown schematically in FIG. 2. The acoustically radiating surface 27 of the diaphragm is concave, and lies adjacent to a correspondingly convex input surface 29 of the phase plug 3. Both the concave acoustically radiating surface 27 and the convex input surface 29 comprise part of a sphere (or an ellipsoid, but preferably a sphere) in shape, and they are substantially concentric. The phase plug 3 includes a plurality of channels 7 extending from its input side (adjacent to the diaphragm 1) to its output side (closer to the horn waveguide 5) for propagating acoustic waves through the body of the phase plug. Consequently, the input surface 29 of the phase plug 3 includes a plurality of openings 31 constituting entrances for the channels 7. More particularly, the phase plug 3 includes three substantially coaxial annular channels 7, having respective coaxial annular slot entrance openings 31*a*, 31*b* and 31*c*. Annular slot 31*a* is the closest to the central axis X-X, annular slot 31*c* is the furthest from the central axis X-X, and annular slot 31*b* is situated between slots 31*a* and 31*c*. Each slot 31 has a substantially constant (fixed) width for substantially its entire extent, but the width of each slot is different to the width of each other slot, in a particular defined relationship (described below).

Figure 4:
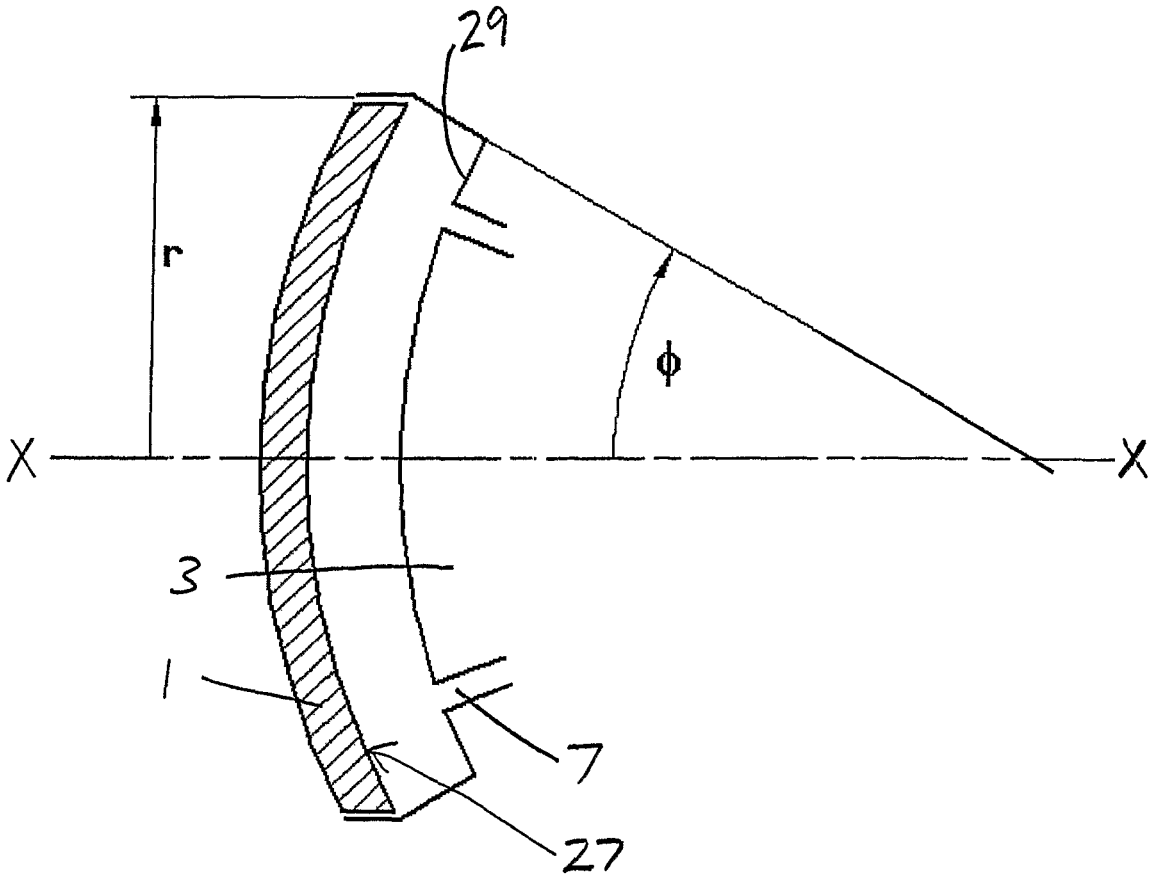
FIG. 4 is a schematic diagram indicating the radial position r and the angle $\phi$ used to define features of the invention.

The inventors of the present invention have found that if the areas, and the widths, of the slots 31 vary as a function of the cosine of the angle subtended at the centre of the sphere (or a focus of the ellipsoid) defining the input surface 29 of the phase plug between the central axis X-X and the radial position of the slot on the input surface, then the phase plug can significantly reduce, or can even substantially eliminate, the excitation of acoustic resonances (cavity modes) in the region between the diaphragm 1 and the throat of the horn waveguide 5. The definitions of the angle (which is designated as $\phi$) and the radial position (which is designated as r) are illustrated in FIG. 4. The radial position r is measured in a direction extending perpendicularly from the central axis X-X extending through the input surface 29 of the phase plug 3. (The particular value of the angle $\phi$ and the particular value of the distance r shown in FIG. 4 constitute just one such angle and one such radial distance; each of the slots 31 will have its own particular value of the angle $\phi$ and the radial distance r, defined and measured from the central axis X-X as shown in FIG. 4.)

The inventors have found, in particular, that acoustic resonances can be significantly reduced (or even substantially eliminated) if the variation in the areas of the openings 31 (e.g. slots) is substantially proportional to a function in the range $r\cdot\cos^{1/2}\phi$ to $r\cdot\cos^2\phi$. Thus, for example, for some embodiments of the invention, the variation may be substantially proportional to $r\cdot\cos\phi$.

Figure 5:
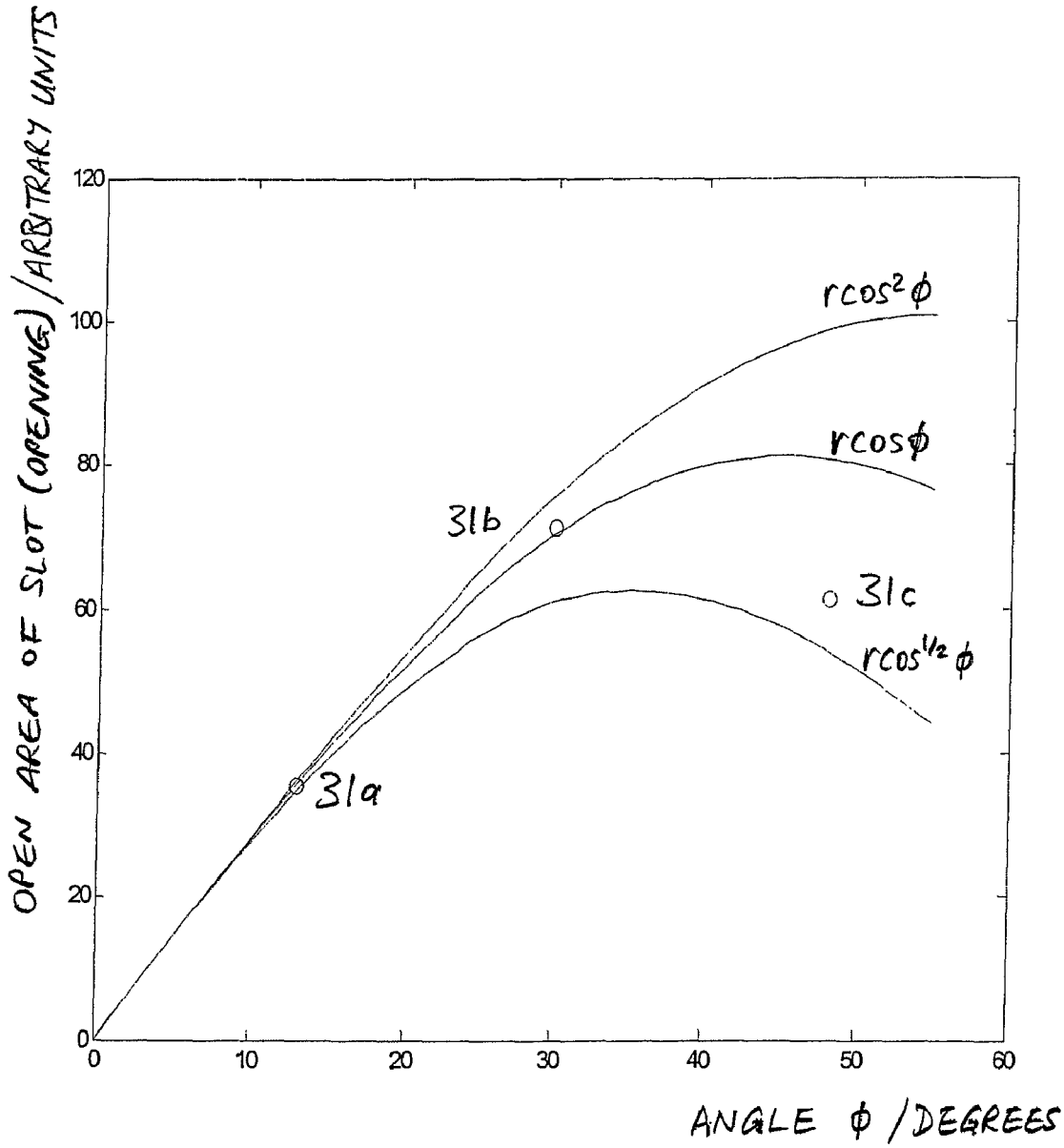
FIG. 5 is a graphical representation indicating variations in channel entrance opening areas and slot widths of preferred embodiments of phase plugs according to the invention.

The variation in the areas of the slots 31*a*, 31*b* and 31*c* of FIG. 2 is shown graphically in FIG. 5, in which the horizontal axis indicates the angle $\phi$ of each slot (in degrees), and the vertical axis indicates the open area of each slot (in arbitrary units). Each of the slots 31*a*, 31*b* and 31*c* is indicated on the graph (as a small labelled oval), together with the functions $r\cdot\cos^{1/2}\phi$, $r\cdot\cos\phi$ and $r\cdot\cos^2\phi$. As can be seen, all of the slots fall within the range defined by the limits $r\cdot\cos^{1/2}\phi$ and $r\cdot\cos^2\phi$.

Additionally (as mentioned above) the widths W of the annular slots of the phase plug 3 illustrated in FIG. 2 preferably vary substantially in proportion to a function in the range $\cos^{1/2}\phi$ to $\cos^2\phi$. More preferably, the widths W of the slots vary approximately in proportion to cost. The widths W of the slots are indicated in FIG. 2.

Figure 3:
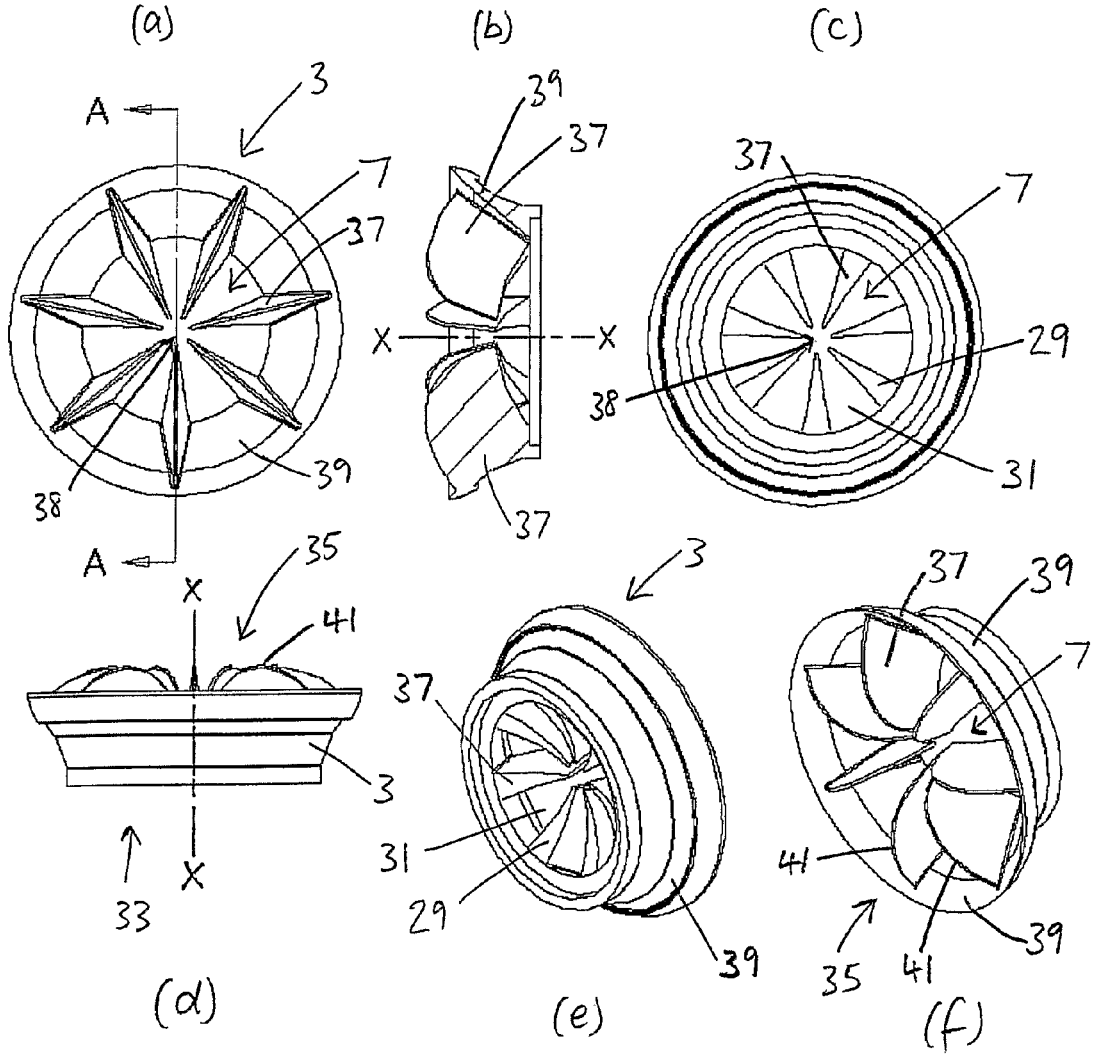
FIG. 3 shows six views (*(a)* to *(f)*) of a second embodiment of a phase plug according to the invention.

FIG. 3 shows six views ((*a*) to (*f*)) of an alternative embodiment of a phase plug 3 according to the invention. The phase plug 3 of FIG. 3 comprises a body having an input side 33 for receiving acoustic waves and an output side 35 for transmitting acoustic waves. A plurality of channels 7 extends from the input side 33 to the output side 35 for propagating acoustic waves through the body of the phase plug 3. The input side 33 comprises a concave input surface 29 which includes a plurality of openings 31 in the form of slots, which constitute entrances for the channels 7. The input surface is substantially part of a sphere (or an ellipsoid, but preferably a sphere) in shape. The slots 31 are arranged in a substantially radial orientation on the input surface 29 about the central axis X-X. In the embodiment illustrated in FIG. 3, the phase plug 3 includes seven channels, and thus seven slots, but fewer, or a greater number, of slots could be used instead. Each channel 7 (and thus also each slot 31, which is an entrance of a channel) is partially defined, and separated from neighbouring channels 7, by a pair of spaced apart fins 37. Because there are seven channels there are also seven radially arranged spaced-apart fins 37. Each fin projects towards the central axis X-X from an outer circumferential part 39 of the phase plug 3. The circumferential part 39 has a generally frusto-conical shape, with its smallest radius adjacent to the input side 33 and its largest radius adjacent to the output side 35.

The area distributions of the slots 31, and thus also the widths of the slots, vary with radial position r on the input surface 29 of the phase plug 3 illustrated in FIG. 3. More particularly, the area distributions and the widths of the slots 31 vary as a function of the radial position r and the cosine of the angle $\phi$ (which are defined in the same way as illustrated in FIG. 4). Specifically, the variation in both the area distributions of the slots 31, and the widths of the slots 31, is substantially proportional to a function in the range $r \cdot \cos^{1/2}\phi$ to $r \cdot \cos^2\phi$, for example approximately proportional to $r \cdot \cos\phi$. Because such a variation in slot width would mean that the width of each slot reduces to zero at the central axis X-X (where r=0), the phase plug could include an axially central part of the phase plug body where all of the fins 37 are joined together. However, in order to comply with the ideal mathematical variation in slot width, any such axially central part of the phase plug body would ideally need to be vanishingly small in radius (which is difficult or impossible to achieve). Thus, the physical embodiment of the phase plug at the central axis X-X will generally be an approximation to the ideal mathematical variation in slot width, e.g. either comprising a small axially central part of the phase plug body or comprising an axially central opening 38 which joins all of the slots to each other. The latter version is the one illustrated in FIG. 3.

While the slot openings 31 on the input surface 29 of the phase plug 3 of FIG. 3 comply with the above-mentioned mathematical relationships, the output sides of the channels 7 do not necessarily comply with those mathematical relationships. In FIG. 3, each channel 7 widens in an approximately exponential manner in a direction parallel to the central axis X-X from the input side 33 to the output side 35. As shown in view (*f*) of FIG. 3, the output edge 41 of each fin 37 has a thin substantially constant width. Additionally, the output edge 41 of each fin 37 curves substantially continuously from the circumferential part 39 at the output end 35 of the phase plug 3, to the radially innermost part of the fin at the input surface 29.

Figure 6:
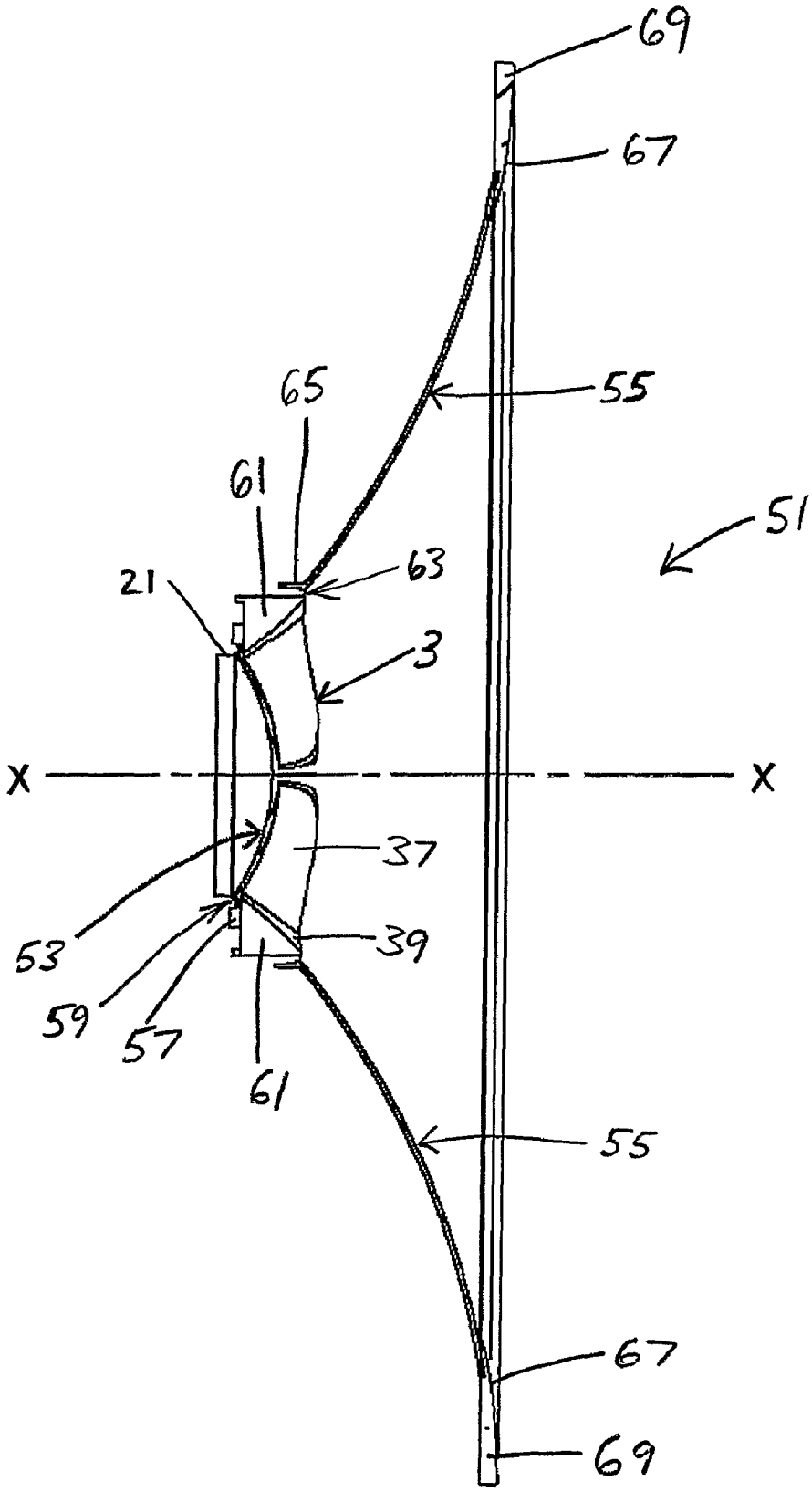
FIG. 6 is a schematic cross-sectional representation of a combination loudspeaker according to the invention, comprising a convex radiating diaphragm, a phase plug of the type illustrated in FIG. 3, and a radiating horn diaphragm.

FIG. 6 is a schematic cross-sectional representation of a combination loudspeaker 51 according to the invention, comprising a convex dome-shaped radiating diaphragm 53, a phase plug 3 of the type illustrated in FIG. 3, and a radiating horn diaphragm 55. The convex radiating diaphragm 53 and the phase plug 3 are located in the throat of the horn diaphragm 55. The convex radiating diaphragm 53 is arranged to radiate high frequency sounds, and the horn diaphragm 55 is arranged to radiate low or mid-range frequency sounds. The combination loudspeaker 51 includes a "surround" 57 in the throat of the horn diaphragm 55 that supports the convex radiating diaphragm 53 via a flexible annular web 59, and attached to this surround 57 is a support 61 for the phase plug 3. An inner cylindrical part 65 of the horn diaphragm 55 carries a conductive coil of a driver for the horn diaphragm, which extends into a magnetic gap of the driver (not shown). The horn diaphragm 55 is supported by a second flexible annular web 67 at its outer periphery, and the outer periphery of the second flexible annular web 67 is attached to an outer support 69.

It will be understood that other embodiments of the invention, and modifications of the described and illustrated embodiments of the invention, are possible within the definitions of the invention provided in the appended claims.

The invention claimed is:

1. A phase plug, comprising a body having an input side for receiving acoustic waves and an output side for transmitting acoustic waves, the body including a plurality of channels extending from the input side to the output side for propagating acoustic waves through the body, wherein the input side comprises an input surface which includes a plurality of openings constituting entrances for the channels, the input surface being substantially part of a sphere or an ellipsoid in shape, and wherein the areas of the openings vary with radial position on the input surface, the radial position being measured in a direction extending perpendicularly from a central axis extending through the input surface, the variation in the areas of the openings being substantially proportional to a function in the range $r \cdot \cos\frac{1}{2}\Phi$ to $r \cdot \cos 2\Phi$, where r is the radial position and $\Phi$ is an angle subtended at the centre of the sphere or a focus of the ellipsoid between the central axis and the radial position.

2. A phase plug according to claim 1, in which the variation in the areas of the openings is also a function of the radial position.

3. A phase plug according to claim 1, in which the variation in the areas of the openings is substantially proportional to $r \cdot \cos\Phi$, where r is the radial position and $\Phi$ is the angle.

4. A phase plug according to claim 1, in which one or more of the openings has the form of one or more slots, each slot having a constant or varying width.

5. A phase plug according to claim 4, in which all of the openings have the form of slots.

6. A phase plug according to claim 4, in which the widths of the slots vary substantially in proportion to a function in the range $\cos\frac{1}{2}\Phi$ to $\cos 2\Phi$, where $\Phi$ is the angle, and preferably, vary substantially in proportion to $\cos\Phi$, where $\Phi$ is the angle.

7. A phase plug according to claim 6, in which the width of each slot varies substantially in proportion to $r \cdot \cos\Phi$, where r is the radial position and $\Phi$ is the angle.

8. A phase plug, comprising a body having an input side for receiving acoustic waves and an output side for transmitting acoustic waves, the body including a plurality of channels extending from the input side to the output side for propagating acoustic waves through the body, wherein the input side comprises an input surface which includes a plurality of slots constituting entrances for the channels, the input surface being substantially part of a sphere or an ellipsoid in shape, and wherein the widths of the slots vary with radial position on the input surface, the radial position being measured in a direction extending perpendicularly from a central axis extending through the input surface, the slot widths varying substantially in proportion to a function in the range $r \cdot \cos\frac{1}{2}\Phi$ to $r \cdot \cos 2\Phi$, where r is the radial position and $\Phi$ is an angle subtended at the centre of the sphere or a focus of the ellipsoid between the central axis and the radial position.

9. A phase plug according to claim 8, in which the variation in the widths of the slots is also a function of the radial position.

10. A phase plug according to claim 8, in which one or more of said slots are arranged in a substantially radial orientation on the input surface about the central axis.

11. A phase plug according to claim 10, in which the slots are joined to each other via an opening at an axially central region of the input surface.

12. A phase plug according to claim 10, in which each slot is arranged such that the axis of its annulus is substantially coaxial with the central axis.

13. A phase plug according to claim 10 when dependent upon claim 10, which includes one or more radial slots and one or more annular slots.

14. A phase plug according to claim 8, in which one or more of said slots are substantially annular or substantially part of an annulus, in shape.

15. A phase plug according to claim 8, in which the input surface is concave.

16. A phase plug according to claim 8, in which the input surface is convex.

17. A compression driver, comprising a phase plug including body having an input side for receiving acoustic waves and an output side for transmitting acoustic waves, the body including a plurality of channels extending from the input side to the output side for propagating acoustic waves through the body, wherein the input side comprises an input surface which includes a plurality of openings constituting entrances for the channels, the input surface being substantially part of a sphere or an ellipsoid in shape, and wherein the areas of the openings vary with radial position on the input surface, the radial position being measured in a direction extending perpendicularly from a central axis extending through the input surface, the variation in the areas of the openings being substantially proportional to a function in the range $r \cdot \cos \frac{1}{2}\Phi$ to $r \cdot \cos 2\Phi$, where r is the radial position and $\Phi$ is an angle subtended at the centre of the sphere or a focus of the ellipsoid between the central axis and the radial position; and an acoustically radiating diaphragm situated adjacent to the input side of the phase plug.

18. A compression driver according to claim 17, in which the diaphragm has a convex acoustically radiating surface.

19. A compression driver according to claim 18, in which the acoustically radiating surface of the diaphragm is substantially part of a sphere or an ellipsoid in shape.

20. A compression driver according to claim 17, in which the diaphragm has a concave acoustically radiating surface.

21. A compression driver according to claim 17, in which the acoustically radiating surface of the diaphragm is substantially rigid.

22. A compression driver according to claim 17, further comprising a horn waveguide situated adjacent to the output side of the phase plug.

23. A combination loudspeaker, comprising an acoustically radiating horn diaphragm, a driver for the horn diaphragm, and a compression driver according to claim 17 located in, or adjacent to, a throat of the horn diaphragm.

24. A combination loudspeaker according to claim 23 further comprising a horn waveguide situated adjacent to the output side of the phase plug, in which the acoustically radiating horn diaphragm comprises the horn waveguide of the compression driver.

* * * * *